US007397925B2

(12) United States Patent
Stirnemann et al.

(10) Patent No.: US 7,397,925 B2
(45) **Date of Patent: *Jul. 8, 2008**

(54) HEARING DEVICE SYSTEM AND METHOD FOR MANUFACTURING SUCH DEVICE

(75) Inventors: Alfred Stirnemann, Zollikon (CH); Hilmar Meier, Zürich (CH)

(73) Assignee: Phonak AG, Stafa (CH)

( * ) Notice: Subject to any disclaimer, the term of this patent is extended or adjusted under 35 U.S.C. 154(b) by 852 days.

This patent is subject to a terminal disclaimer.

(21) Appl. No.: 10/775,711

(22) Filed: Feb. 10, 2004

(65) Prior Publication Data

US 2005/0175200 A1 Aug. 11, 2005

(51) Int. Cl.
*H04R 25/00* (2006.01)

(52) U.S. Cl. ..... 381/312

(58) Field of Classification Search ..... 281/60, 281/23.1, 312, 314, 323
See application file for complete search history.

(56) References Cited

U.S. PATENT DOCUMENTS 5,456,691 A 10/1995 Snell
6,914,994 B1 * 7/2005 Shennib et al. ..... 381/312
2003/0091197 A1 5/2003 Roeck et al.

FOREIGN PATENT DOCUMENTS

DE 198 15 373 A1 10/1999
WO WO 03/024148 A2 3/2003

* cited by examiner

*Primary Examiner*—Ping Lee
(74) *Attorney, Agent, or Firm*—Pearne & Gordon LLP

(57) ABSTRACT

A hearing device has an acoustical/electrical input converter, and electrical/mechanical output converter, and a digital signal processing unit connected between the input converter and output converter. The device is adapted to a specific ear of a specific individual. The signal processing unit is controllable in at least two operating modes. In a first mode, the device is substantially acoustically transparent. The processing unit is controlled in the first mode by a dedicated program module independent of any further program module for any other operating mode. Alternatively the processing unit is controlled in the first mode by a program operating in the first mode controlled by a dedicated set of parameters independent of any further set of parameters for any other operating mode.

6 Claims, 3 Drawing Sheets

HEARING DEVICE SYSTEM AND METHOD FOR MANUFACTURING SUCH DEVICE

Figure 1:
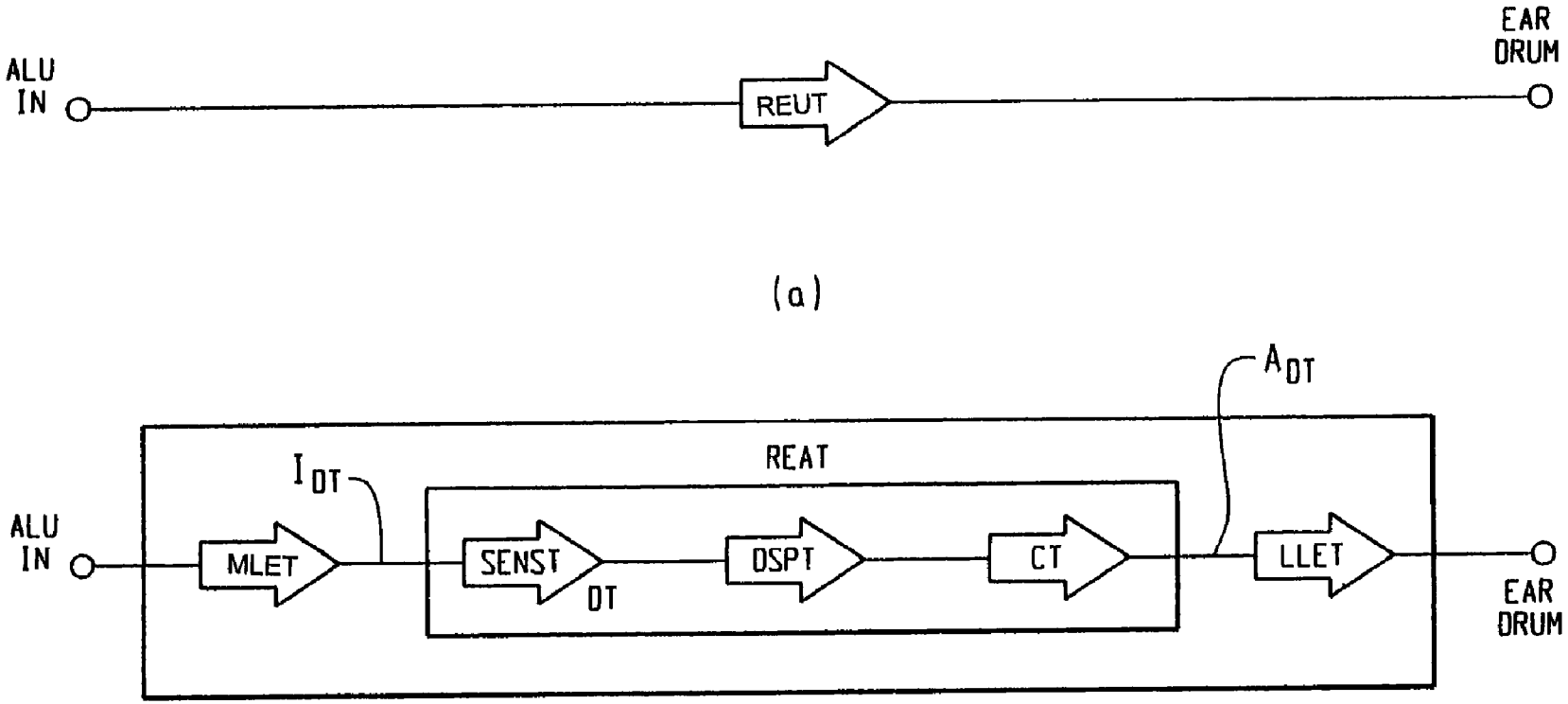

The present invention is directed on a hearing device system with at least one hearing device having at least one acoustical/electrical input converter arrangement, at least one electrical/mechanical output converter arrangement, and a digital signal processing unit operationally interconnected between the output of the input converter arrangement and the input of an output converter arrangement.

It is further directed on a method for manufacturing such a system.

The overall intrinsic function of a hearing device, and, accordingly, of a binaural hearing system, is to provide to the individual user a desired improvement of acoustical signal perception. Thereby an improvement is to be related to a specific acoustical situation. Thus a desired improvement may also be attenuation of non-desired noise and consequently a hearing device or system may be a hearing protection device or system as addressed or a hearing capability increasing device or system. A desired improvement is realised at today's digital monaural hearing devices and digital binaural hearing systems by appropriate hardware and programming conception, and by appropriately setting and adjusting a multitude of parameters. The DSP (digital signal processing unit) is controlled by a programme often switchable in different control modes which are e.g. adapted to specific hearing situations as to noisy situations, concert hall situation etc. The setting and fitting of the multiple-parameter-transmission characteristics between acoustical input and mechanical output of the device to an individual is highly complex, especially due to interdependencies of the effects of the parameters to be adjusted. Often varying one parameter of the transmission characteristic necessitates readjusting parameters which had already been pre-adjusted. Thus the overall fitting procedure is a highly sophisticated process to find an optimum setting of all parameters involved.

From the WO 03/024148 it is known to provide a canal hearing device which may be operated in transparent mode. As the present invention also deals with exploiting such transparent mode, by means of FIG. 1, the transparent mode shall be defined. According to FIG. 1(*a*) an impinging acoustical signal to an individual's ear is transmitted to the ear drum with the Real Ear Unaided Transfer Function REUT. Whenever a hearing device, be it an outside-the-ear hearing device or an in-the-ear hearing device, is applied to individual's ear considered, the following transfer functions contribute to the overall transmission between the impinging acoustical signal and the ear drum, concomitantly forming the Real Ear Aided Transfer function REAT: The transfer function of the device itself DT, between acoustical input $I_{DT}$ and acoustical or mechanical output $A_{DT}$ is defined by the respective hearing device per se. The device transfer function DT may be subdivided e.g. in the transfer function SENST, which defines the transfer function between acoustical input to the device and input to the digital signal processing unit DSP, the transfer function of the digital signal processing unit DSPT and the conversion transfer function CT between the output of the digital signal processing unit and the acoustical or mechanical output of the device, $A_{DT}$.

Dependent from the type of hearing device, its individual shaping, its location at the individual, upstream the acoustical input of the device $I_{DT}$ a further transfer function MLET applies, which takes into account the acoustical/acoustical signal transfer along the respective parts of the individual's ear up to the acoustical input to the device $I_{DT}$.

Thus, the transfer function MLET will e.g. be significantly different for a CIC, a Completely-In-the-Canal device, than for an Outside-The-Ear-OTE-device, whereby in latter case MLET will not be influenced by directivity characteristics of the pinna, whereas in the case of a CIC the MLIT is. The transfer function LLET takes into account the acoustical/acoustical signal transmission between the acoustical output of the device DT and the ear drum.

For operating the hearing device DT in transparent mode the overall transfer function REAT is, in an ideal case, equal to the transfer function REUT. This is true if there is valid:

$$REUT=MLET+SENST+DSPT+CT+LLET$$

and thus for the DSP operating in transparent mode setting $DSPT_t$:

$$DSPT_t=REUT-MLET-SENST-CT-LLET$$

Therein for a specific hearing device to be applied at a predetermined location of individual's ear the transfer functions MLET and LLET are predetermined as by default values, by measurement at the individual's ear or by individual estimates by the fitting software, whereas the transfer functions SENST and CT are predetermined by the hardware conception of the device. The transfer function of the DSP is thus to be tailored as $DSPT_t$ to achieve as closely as possible the above target function REUT pre-established e.g. by measurement: Then the applied hearing device is substantially not perceived by the individual, his hearing capability is equal to the capability without wearing the hearing device, according to REUT.

Up to now we have considered a monaural hearing device system. The same consideration may be done for a binaural hearing device system to define for the conditions which have to be fulfilled to make the binaural hearing device system not perceived by the individual, thus being "transparent".

The above mentioned WO 03/024148 addresses such transparent mode for a canal hearing device to be activated especially as a power consumption reduction mode of the device.

As was mentioned above, fitting of the multiple parameters and of multi-operation modes of hearing devices is a very complex task.

Today, programming of the DSP is performed as one complex programming task leading to a most complex programme, which is to be conceived in a multitude of subprogrammes, which are very often snugly interdependent.

It is an object of the present invention to provide a hearing device system with simplified programming and/or parameter setting and accordingly to provide a method for manufacturing such system. The object with respect to the device system is accomplished by a hearing device system with at least one hearing device which has an acoustical/electrical input converter arrangement, an electrical/mechanical output converter arrangement, a digital signal processing unit which is operationally interconnected between an output of the input converter arrangement and the input of the output converter arrangement. The device is further adapted to a specific ear of a specific individual and the signal processing unit is controllable in at least two operating modes, a first mode thereof being realized so that the device in the ear of the individual is substantially transparent.

Further, the processing unit is thereby controlled in the first mode, the transparent mode, by a dedicated programme module, which is independent of any further programme module provided, controlling the processing unit in any of the further operating modes. In an alternative embodiment the digital signal processing unit is controlled by a programme which operates in the first mode, the transparent mode, controlled by a dedicated set of parameters, which is independent from any further set of parameters provided for controlling the programme in any further operating mode.

By the fact that the transparent mode of the at least one hearing device or in a binaural system of both hearing devices is controlled by a dedicated programme module or a dedicated set of parameters, the significant advantage is reached that in fact there is provided a reference operating mode, programme and setting of the system upon which further operating modes may be hooked on and may be independently programmed, set and adjusted. For instance and with any eye on a hearing aid device system all programming or parameter setting and fitting which establishes for the hearing impaired individual's improved hearing is realized by a programme module or parameter setting which is realized independently from the dedicated programme module or the dedicated set of parameters which establishes transparency of the system considered. Thus, for all additional programming and fitting to achieve a specific hearing improvement there is created by the dedicated transparent programming or setting a reference system, whereupon development of the additional operating modes may reside.

In a preferred embodiment of the system according to the present invention there is provided a weighting unit which is controllable and by which weighting of the controlling effect of the dedicated programme module, for establishing transparency, or of the dedicated set of parameters with respect to the further module or further sets of parameters is controllably varied. One may thereby apply for an intermode of operation modes, whereat the transparency mode takes control of the overall transfer function REAT to a certain amount, whereas the at least one second mode as for improving individual's hearing in a specific acoustical situation takes influence too upon the REAT to a further predetermined amount.

In a further preferred mode of operation control of the weighting function is automatically done from the digital signal processing unit, e.g. according to specific acoustical situations, which are prevailing. Nevertheless, it is clear that weighting control may additionally or exclusively be performed manually, e.g. via a remote system control.

In spite of the fact that controlling the above mentioned weighting of the respective effects may be done binarily, i.e. in a switching mode, thereby switching either to the transparency or to another operating mode, in a further preferred embodiment and as was already outlined above, there is provided a control with which the effect on one hand of the transparency mode, on the other hand of at least one further operating mode may steadily be varied.

The object of significantly improving manufacturing of hearing device systems as addressed above is reached by the method for manufacturing a hearing device system with at least one hearing device adapted at least to a specific ear of a specific individual, which has an input acoustical/electrical converter arrangement, an output electrical/mechanical converter arrangement and a digital signal processing unit, which is operationally interconnected between the output of the input converter arrangement and the input of the output converter arrangement. The signal processing unit is thereby controlled by a programme which defines signal transmission from the acoustical input signal to the input converter arrangement, to the mechanical output of the output converter arrangement in at least two different modes. One thereof defines the said signal transmission for transparent transmission mode. Further, there is applied a first programme module which controls the signal processing unit in the transparent mode. At least one second programme module is provided, which is independent from the first programme module, and which controls the processing unit in any further mode. In an alternative there is provided a first set of parameters which controls the programme in transparent mode, and which is independent from at least one second set of parameters which controls the processing unit in any further operating mode.

Thereby, in a most preferred embodiment programming of the one programming module which controls transparency operation mode is performed at least substantially independently from programming the at least one second programme module for any further operating modes of the device.

In analogy the method according to the present invention in one alternative form allows first to apply and adjust a set of parameters which establishes at the digital signal control unit, via the one programme, transparency mode. It is upon this setting as a reference that further parameters of a further parameter set may then be established and fitted for specific needs of the individual, as e.g. for improving hearing of a specifically hearing impaired individual.

The invention shall now further be exemplified with the help of figures.

Figure 2:
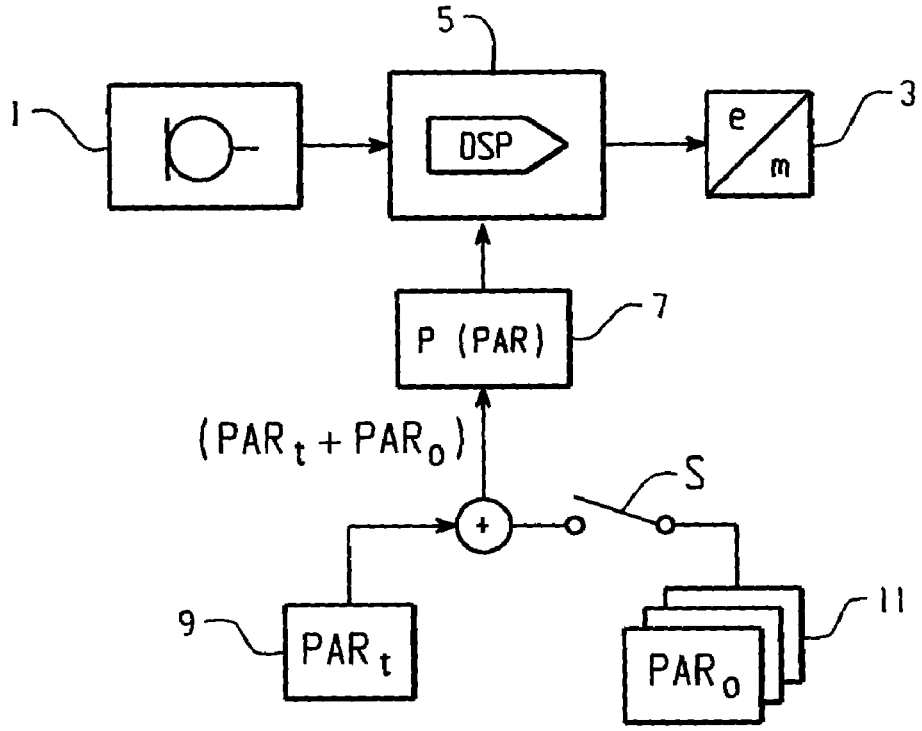
Figure 3:
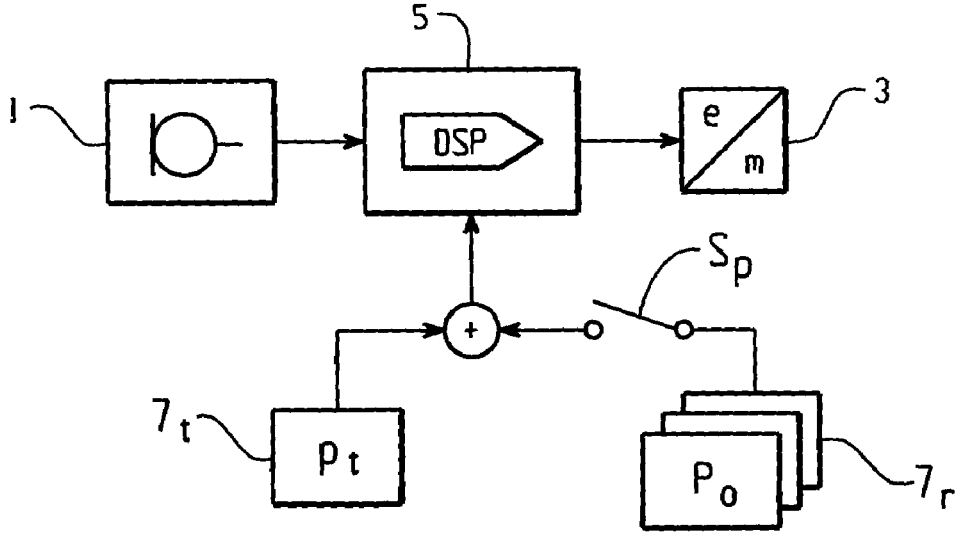
Figure 4:
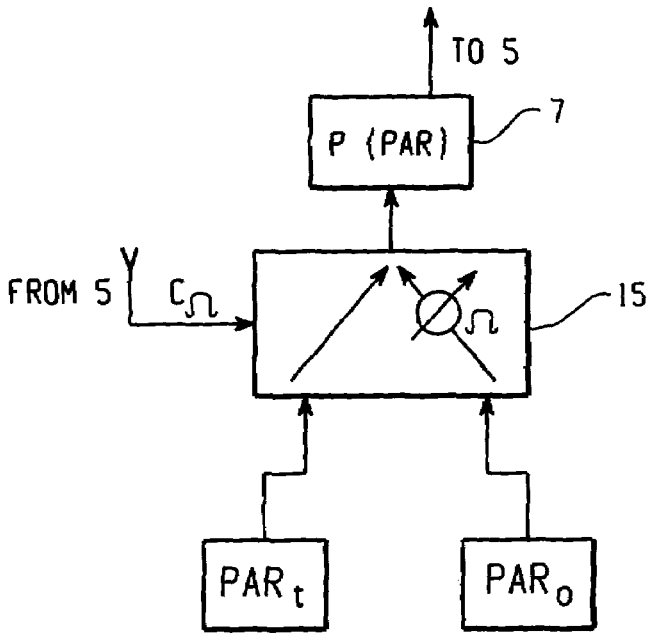
Figure 5:
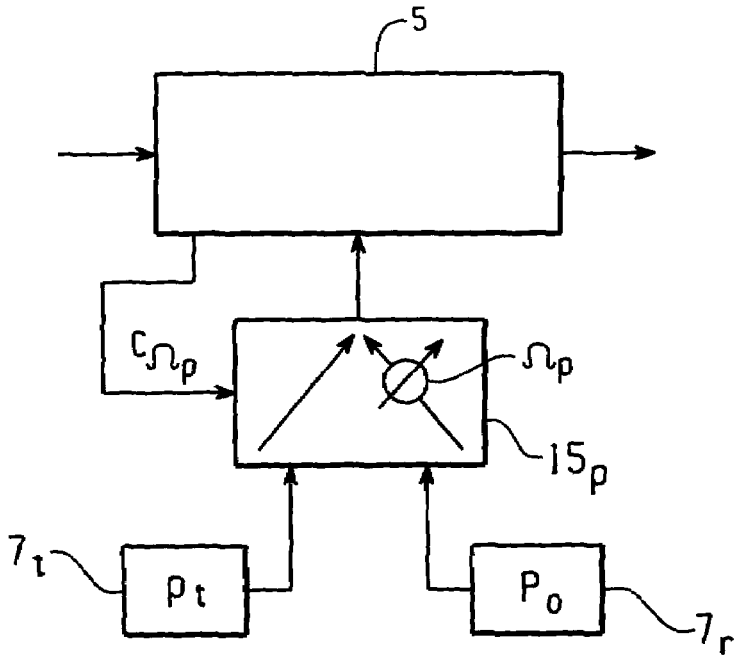

The figures show:

FIG. 1 shows an acoustic transfer function diagram;

FIG. 2 a simplified functional block/signal flow diagram showing a first embodiment of a system according to the present invention manufactured according to a first embodiment of the method according to the present invention;

FIG. 3 in a representation in analogy to that of FIG. 2, a preferred embodiment of the system according to the present invention and manufactured according to the method of the present invention;

FIG. 4 still in a representation in analogy to that of the FIGS. 2 and 3, an improvement of the embodiment according to FIG. 2;

FIG. 5 still in a representation in analogy to that of the FIGS. 2 to 4, an improvement of the embodiment according to the FIG. 3.

In FIG. 2 there is schematically and simplified shown a signal flow/functional block diagram of a single ear hearing device system according to the present invention. It comprises an input acoustical/electrical converter arrangement 1, an output electrical/mechanical converter arrangement 3 and a digital signal processing unit 5, the input thereof being operationally connected to the output of the input converter arrangement 1, the output thereof being operationally connected to the input of the output converter arrangement 3. The digital signal processing unit 5 applies according to FIG. 1 the signal transfer function DSPT. Thereby, the transfer function of the DSP is controlled by a programme module 7. Dependent on the parameters which are set in the controlling programme in programme module 7 the DSP is controlled to provide for different signal transmission modes.

Parameterization of the programme in programme module 7 is performed with a first dedicated set of parameters $PAR_t$, which e.g. is loaded in storage unit 9 within the device. Whenever $PAR_t$ parameterizes the programme P in programme module 7 the DSP in unit 5 is operated in transparency mode, i.e. with the transfer function $DSPT_t$.

There is provided one or more than one additional set of parameters $PAR_o$, e.g. in storage unit 11.

As schematically shown in FIG. 2 the parameters $PAR_o$, which parameterize the programme in programme module 7 for operating modes of the DSP different from transparent mode, i.e. for instance in specific hearing improvement modes, do not just replace the transparent mode controlling parameters $PAR_t$ when enabled, but are in fact adjusting the parameters of $PAR_t$ as schematically shown by switch S. Thereby the transparent mode is kept the reference mode. Thus, if none of the sets of parameters $PAR_o$ is enabled, the hearing device operates in transparent mode. Whenever one or more than one of the $PAR_o$ parameter sets is enabled, the values of the parameters of set $PAR_t$ are varied by values according to the $PAR_o$ parameters, whereby the same parameters of $PAR_t$ may be set to 0, change signum and parameters of $PAR_t$ which have a value 0 may be changed by the $PAR_o$ parameters to respective positive or negative values.

Therefrom, it becomes clear that the reference setting of the DSP by the reference parameter set $PAR_t$ is to operate in transparency mode and setting and adjusting the parameters to operate the device in operating modes different from the transparency mode are defined and set relative to the transparency mode parameters $PAR_t$.

For the skilled artisan it is perfectly clear that by means of the parameter set $PAR_o$ the reference parameter set $PAR_t$ may also be multiplicatively changed in that $PAR_o$ defines for multiplication factors or some parameters $PAR_t$ may be additively, some multiplicatively adjusted by the $PAR_o$ values. Further mathematical rules may be applied to adjust the $PAR_t$ by the $PAR_o$ values.

Thus, by the embodiment as shown in FIG. 2 there is one programme module which controls the transfer function DSPT of the digital signal processing unit DSP and the transparency mode operation of the DSP is established by a dedicated set of parameters $PAR_t$. Additional further operating modes are established by varying the $PAR_t$ parameters as gives by one or more than one further set of "adjusting" parameters $PAR_o$. Whenever a hearing device has been set and fitted in transparent mode, setting and adjusting of the parameters for non-transparent operation modes will be based on the established reference situation of transparency.

The transparency mode parameter set may e.g. be established in the hearing device as read-only data, storage unit 9 then being a ROM. Thus, whenever the non-transparent mode controlling parameters $PAR_o$ have to be changed e.g. according to development of hearing diseases, one may start with the fitting operation at the reference, transparent situation. This makes fitting and re-fitting of the parameters $PAR_o$ significantly easier.

In FIG. 3 there is again shown a simplified signal flow/functional block diagram of a hearing device according to the present invention and manufactured according to the method of the present invention. The DSP in unit 5 and according to FIG. 3 is controlled from a dedicated programme module $\mathbf{7}_t$ into transparency mode. Non-transparency modes are enabled, as schematically shown by switching $S_p$, by additionally activating at least one programme module $\mathbf{7}_o$ to become effective upon the DSP. Thus, programming of the programmes $P_o$ of the modules $\mathbf{7}_o$ is performed as if the DSP was intrinsically operating in transparency mode, and thus acoustically non-existing. Programming of $P_t$ is performed independently from any additional programme $P_o$ whereas programming of $P_o$ modules is performed independently from $P_t$ just on the basis of the desired hearing performance. This allows a clear structuring of programming. The transparency programme $P_t$ may e.g. be changeable only by a small group of authorized people or instances. A larger group of persons or instances may change the $P_o$ modules according to changing needs of the individual.

In FIG. 4 there is shown, again simplified and schematically by means of signal flow/functional block representation, an improvement of the system according to the present invention and as shown in FIG. 2 and which is manufacture according to the method of the present invention. According to FIG. 2 the parameters of the sets $PAR_o$ are enabled or disabled. Thus, they either become fully effective or are not effective relative to the set of parameters $PAR_t$. According to FIG. 4 there is provided a weighting unit 15, whereat the extent as to which the parameters of the sets $PAR_o$ become effective is weighed by the schematically shown variable coefficient $\Omega$. Whenever $\Omega$ is switched from 0 to 1 or vice versa, we have the situation as shown in FIG. 2. Nevertheless, in a preferred embodiment the weighting coefficient $\Omega$ is steadily changed from 1 to 0 or vice versa and is preferably controlled by the DSP in unit 5 as schematically shown in FIG. 3 at control input $C_\Omega$.

In FIG. 5 and in analogy to FIG. 4 there is shown a preferred improvement of the system as shown in FIG. 3 accordingly manufactured by the method according to the present invention. In FIG. 3 a programme for non-transparent mode operation of unit 5, $P_o$, is either fully enabled or fully disabled. By the improvement according to FIG. 5 there is again provided a weighting unit $\mathbf{15}_p$, at which, as schematically shown by the adjustable unit $\Omega_p$, the extent with which the programme $P_o$ shall become effective, additionally to the transparency mode programme $P_t$, is controllably and preferably steadily variable. In spite of the fact that as coefficient $\Omega$ in FIG. 4 and weighting $\Omega_p$ as of FIG. 5 may be controlled manually, e.g. by a remote control unit for the device system, in a preferred mode either additionally or exclusively, respective weighting is controlled from the DSP unit 5 as shown by control input $C_{\Omega p}$. Thereby, the extent, to which the non-transparent control takes control of the DSP is established e.g. dependent on estimation of instantaneous acoustical situation, which estimation is performed by the DSP.

We have described the system according to the present invention as well as the manufacturing method according to the invention with reference to a monaural system. It is perfectly clear to the skilled artisan that the invention may be applied to binaural hearing systems at which transparency is established with respect to both hearing devices.

The invention claimed is:

1. A hearing device system with at least one hearing device, having an acoustical/electrical input converter arrangement, an electrical/mechanical output converter arrangement, a digital signal processing unit operationally interconnected between an output of said input converter arrangement and an input of said output converter arrangement, said device being adapted to a specific ear of a specific individual, said signal processing unit being controllable in at least two operating modes, a first mode being realized so that the device in said ear of said individual is substantially transparent, said processing unit being controlled in said first mode by a dedicated program module independent of a second program module for a second of said at least two operating modes or being controlled by a program operating in said first mode, controlled by a dedicated set of parameters independent from a second set of parameters controlling said program in a second of said at least two operating modes and wherein said first mode is kept activated when said second of said at least two operating modes is activated as well.

2. The hearing device system of claim 1, further comprising a weighting unit, controllably weighting the effect of said at least two operating modes.

3. The hearing device system of claim 2, wherein said digital signal processing unit controls said weighting unit.

4. The device of claim 2, wherein said weighting unit is controlled to steadily vary said effect.

5. A method for manufacturing a hearing device system with at least one hearing device adapted to at least one specific ear of a specific individual and having an input acoustical/ electrical converter arrangement, an output electrical/mechanical converter arrangement, a digital signal processing unit operationally interconnected between an output of said input converter arrangement and an input of said output converter arrangement, comprising the steps of applying a first program module to control said signal processing unit in a transparent mode and simultaneously applying a second program module for controlling said processing unit additionally in a second processing mode or applying a first set of parameters controlling said processing unit in said transparent mode and simultaneously second set of parameters controlling said processing unit in a second mode.

6. The method of claim 5, comprising programming said first program module at least substantially independently from programming said second program module or performing selecting said first set of parameters substantially independently from selecting said second set of parameters.

* * * * *